US006952993B2

(12) United States Patent
Iwamoto

(10) Patent No.: US 6,952,993 B2
(45) Date of Patent: Oct. 11, 2005

(54) VERSATILE SATELLITE-TYPE PRINTING PRESS

(75) Inventor: Masayuki Iwamoto, Shizuoka (JP)

(73) Assignee: Shinohara Machinery Co., Ltd., Shizuoka-Ken (JP)

( * ) Notice: Subject to any disclaimer, the term of this patent is extended or adjusted under 35 U.S.C. 154(b) by 0 days.

(21) Appl. No.: 10/725,721

(22) Filed: Dec. 2, 2003

(65) Prior Publication Data

US 2005/0115426 A1 Jun. 2, 2005

(51) Int. Cl.[7] ..... B41F 5/018
(52) U.S. Cl. ..... 101/183; 101/216; 101/479; 101/480
(58) Field of Search ..... 101/479, 480, 101/DIG. 49, 216, 183

(56) References Cited

U.S. PATENT DOCUMENTS 5,333,545 A * 8/1994 Ganter et al. ..... 101/76
5,794,531 A * 8/1998 Keller ..... 101/479
6,101,939 A * 8/2000 Giori et al. ..... 101/177
6,510,795 B1 * 1/2003 Detmers et al. ..... 101/480
6,698,650 B2 * 3/2004 Laker et al. ..... 229/160.2

FOREIGN PATENT DOCUMENTS

JP 60-255434 12/1985

* cited by examiner

*Primary Examiner*—Andrew H. Hirshfeld
*Assistant Examiner*—Jill E. Culler
(74) *Attorney, Agent, or Firm*—Ladas and Parry LLP

(57) ABSTRACT

The present invention relates to sheet-fed satellite-type printing press and aims at versatile satellite-type press by which printing mode can easily be modified.

For this purpose, a part of side frames (12) corresponding to the circumference of common pressure cylinder (10) is cut out to form common installing portion (34) and printing unit (38) or sheet perfecting unit (40) can be installed into the common installing portion (34).

Thereby, multi-color printing or perfecting printing can be performed at will.

10 Claims, 8 Drawing Sheets

VERSATILE SATELLITE-TYPE PRINTING PRESS

BACKGROUND OF THE INVENTION

1. Field of the Invention

The present invention relates generally to satellite-type printing press, or more precisely, to versatile satellite-type press by which printing mode can easily be modified.

2. Description of the Prior Art

Satellite-type printing press is known where many printing units (for example, four color units) are provided in satellite-like manner around common pressure cylinder of large diameter. Such satellite-type printing press is a new step toward corresponding to the need of multi-sort short run color printing.

With regard to such satellite-type press, it will surely be convenient if printing mode can be modified at will in compliance with the circumstances of press user. For example, printing unit can be added or sheet perfecting function can be intervened.

In Japanese published unexamined patent specification No. 255434/1985, plurality of bearing holes are bored through side frames for supporting several printing cylinders of series-type press. Sheet transfer cylinders or sheet perfecting cylinders of different diameter are attached to the bearing holes to selectively modify the construction of printing press.

But, according to the prior art technique of series-type press, a great deal of time is required for such modification of press structure, because cylinders must be re-installed in the bearing holes in side frames. In addition, many kinds of troublesome adjustments such as register adjustment are necessitated, as the cylinders to be re-installed are directly concerned with sheet transfer path.

SUMMARY OF THE INVENTION

In view of above-described problems of prior art technique, the present invention provides an improved satellite-type printing press and aims at versatile satellite-type press by which printing mode can easily be modified.

In accordance with versatile satellite-type printing press of the present invention, a EXPRESS MAIL LABEL part of side frames corresponding to the circumference of common pressure cylinder is cut out to form common installing portion and printing unit or sheet perfecting unit can be installed into the common installing portion.

In case printing unit is added to the common installing portion, satellite-type press which is basically four color press turns into five color press and, in case sheet perfecting unit is installed, perfecting printing for both side of sheet is possible.

These and other objects of the invention will become apparent from the following description with reference to the drawings. But, these show merely an embodiment of the present invention.

DESCRIPTION OF PREFERRED EMBODIMENT

Figure 1:
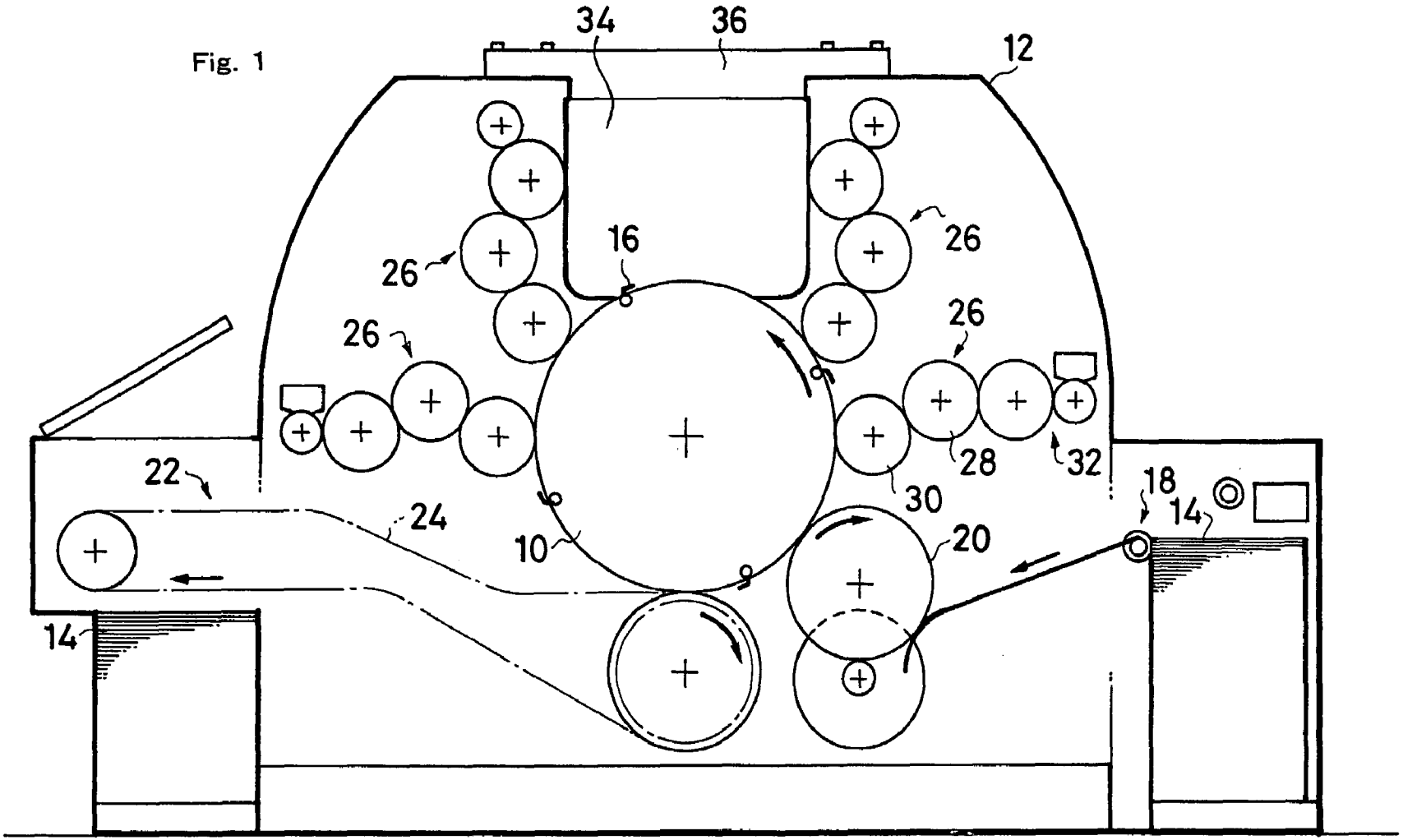
FIG. 1 is a schematic view showing an embodiment of versatile satellite-type printing press according to the present invention.

In the center of FIG. 1, common pressure cylinder 10 of relatively large diameter is shown which is rotatably supported between a pair of side frames 12 of printing press and is driven by motor (not shown). Several grippers 16 which grip the end of sheet 14 are equipped on the periphery of common pressure cylinder 10. The common pressure cylinder 10 is a base for accepting sheet 14 from feeding cylinder 20 of sheet feeder 18 in the upper stream and, after printing, for delivering the printed sheet to delivery chain 24 of sheet delivery device 22 in the lower stream.

Four sets of fixed printing units 26 are provided around common pressure cylinder 10 in satellite-like manner. In order to perform offset printing, these fixed printing units 26 have plate cylinders 28 equipped with printing plates and blanket cylinders 30 to transfer images. Additionally, inking device 32 is attached to plate cylinder 28. The diameter of common pressure, cylinder 10 around which the fixed printing units 26 are provided in satellite-like manner is integer times (for example, four times) as large as that of plate cylinder 28 in order to perform multi-color printing by the fixed printing units 26 in compliance with the rotation of common pressure cylinder 10 which is driven by motor (not shown).

Between the second and the third fixed printing units 26 in the rotational direction of common pressure cylinder 10 (Anti-clockwise in FIG. 1), a part of side frames 12 corresponding to the circumference of common pressure cylinder 10 is cut out, to form common installing portion 34. The common installing portion 34 is opened from the circumference of common pressure cylinder 10 toward outside of press, therefore, can quite easily be accessed from outside. Usually, cap 36 is put on the side frames 12 to prevent dust. The cap 36 has also a role to keep assembling accuracy of press.

Figure 2:
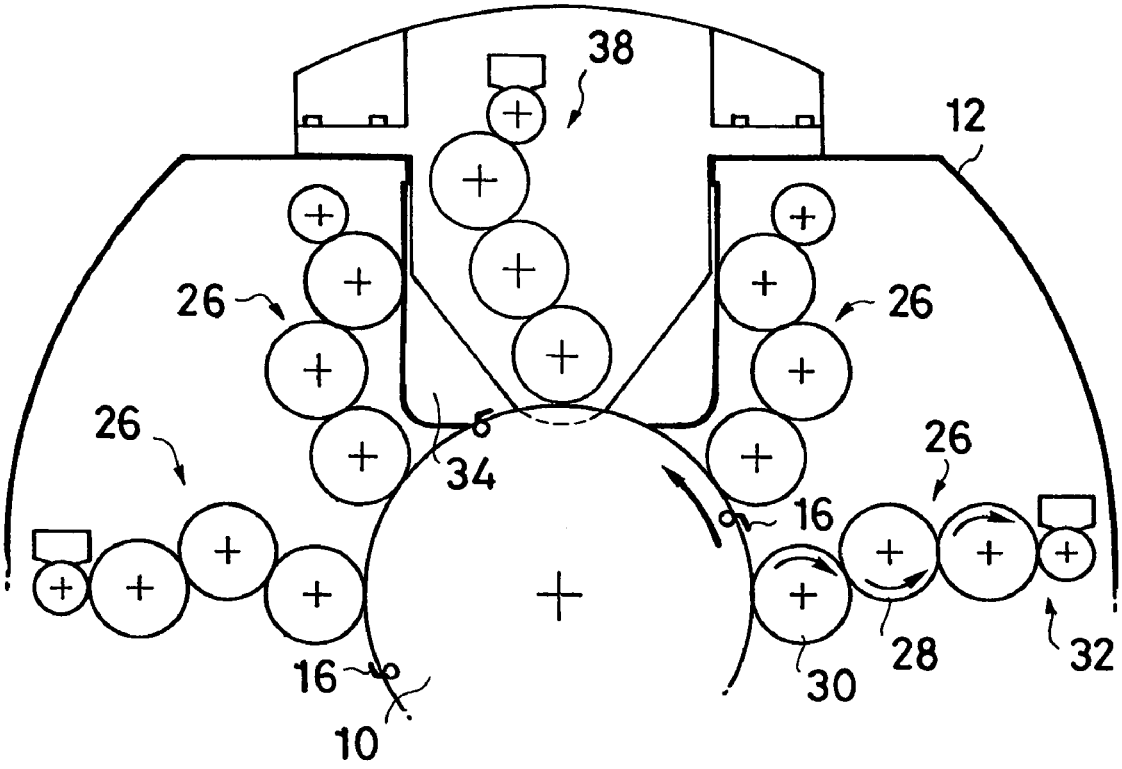
FIG. 2 is a partial section where printing unit is installed into common installing portion.

In the state of FIG. 1, four color printing press is shown with the cap 36 on the common installing portion 34. But, five color printing press is schematically shown in FIG. 2 with a modularized printing unit 38 in the common installing portion 34. To achieve installation, printing unit 38 is set from the cut out common installing portion 34 toward common pressure cylinder 10 and fixed on the upper end of side frames 12. Drive torque for printing unit 38 can be transmitted from common pressure cylinder 10 by way of gear connection. The modularized printing unit 38 to be added may well be the same offset printing unit as other fixed printing units 26. In some other modification, bar code printing unit or numbering unit is also applicable. In all these modifications, exact printing on the base of common pressure cylinder 10 can surely be expected and variety of printing modes can be attained.

Figure 3:
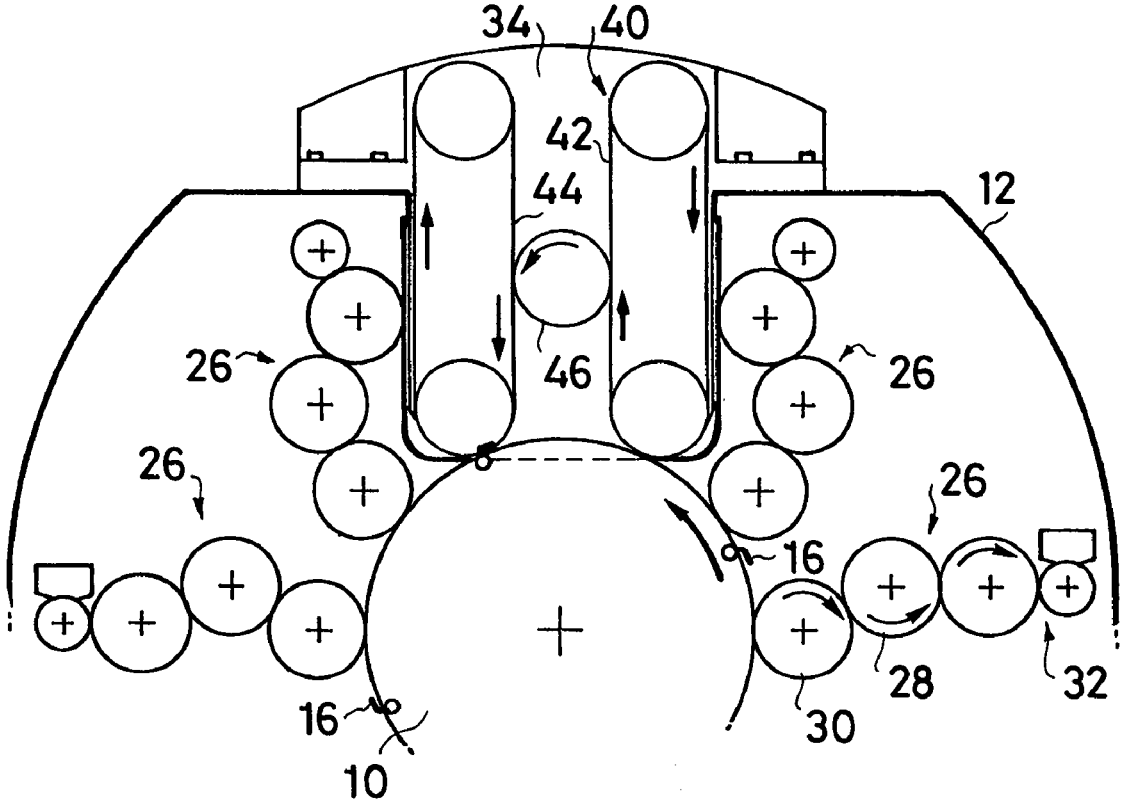
FIG. 3 is another partial section where sheet perfecting unit is installed into common installing portion.

In FIG. 3, a modularized sheet perfecting unit 40 is installed in the common installing portion 34. The sheet perfecting unit 40 reverses sheet 14 which is gripped and transferred by gripper 16 of common pressure cylinder 10. The perfecting unit 10 must also be installed into the common installing portion 34 from outside of press toward the periphery of common pressure cylinder 10. According to sheet perfecting unit 40 shown in FIG. 3, sheet 14 is reversed by a pair of parallel chain gripper means 42, 44 and perfecting cylinder 46 between them and FIGS. 4 to 8 are explanatory views for reference.

Figure 4:
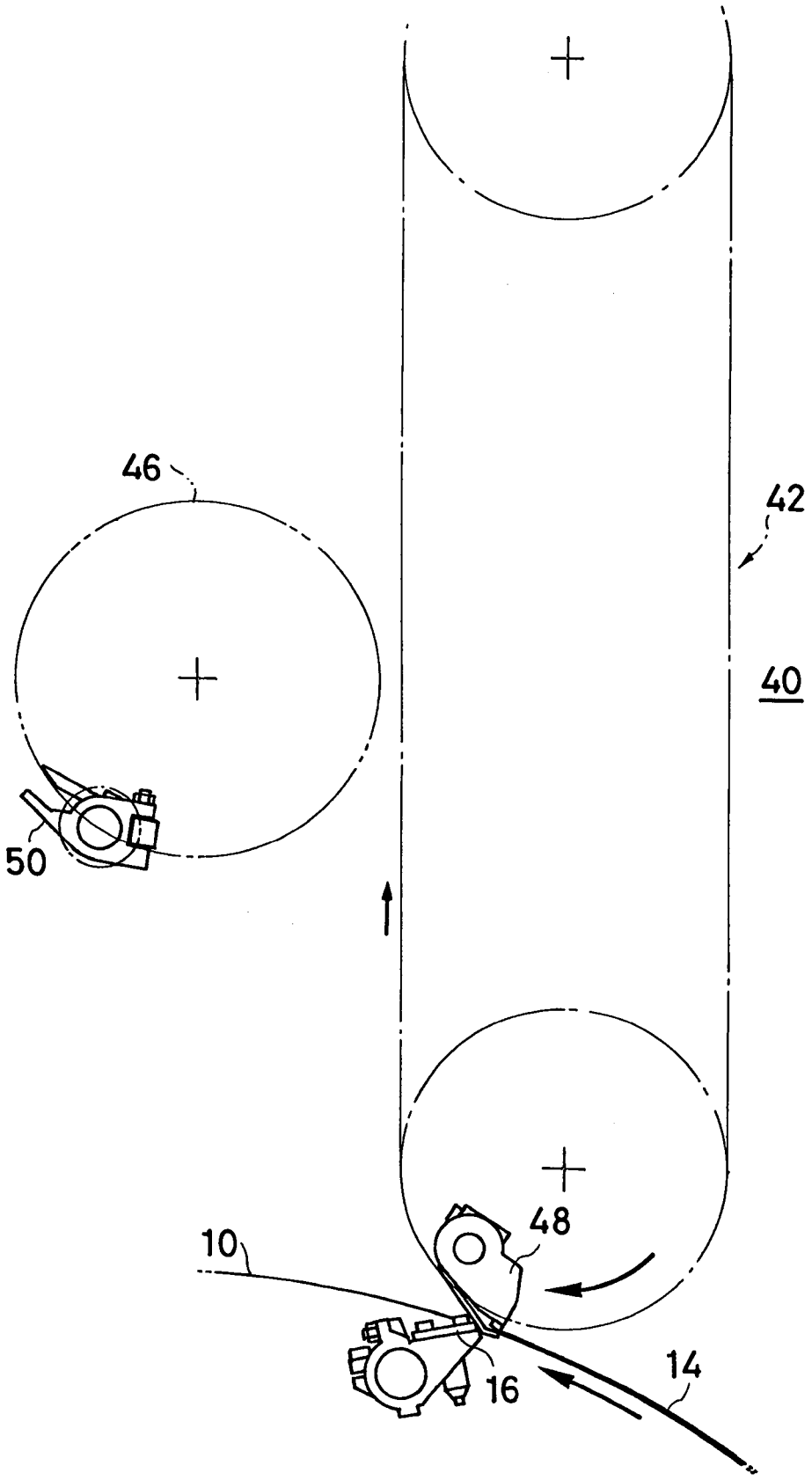
FIG. 4 and under are explanatory views showing the function of sheet perfecting unit and FIG. 4 itself shows a state where sheet is transferred from common pressure cylinder to the first chain gripper.
Figure 5:
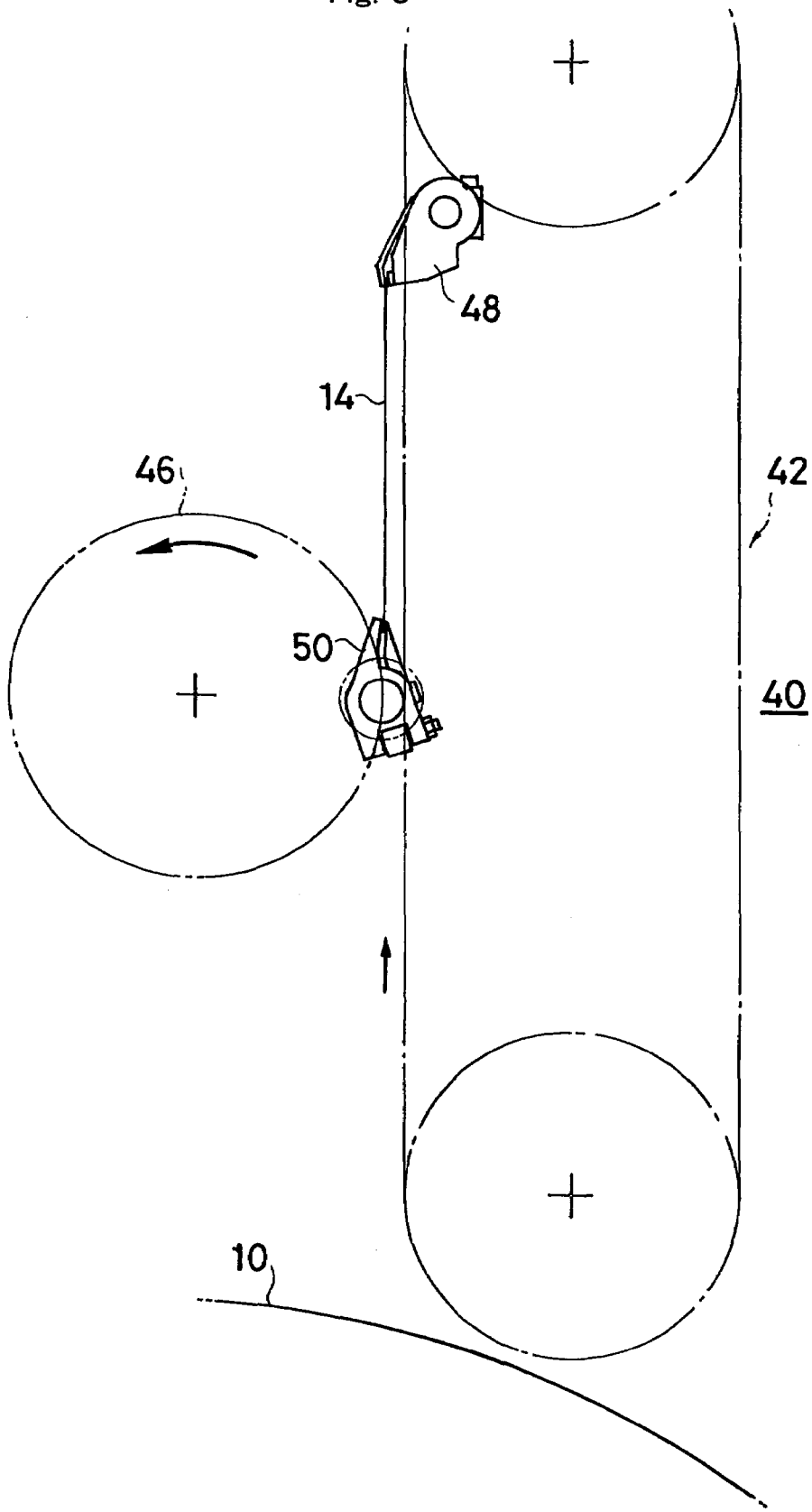
FIG. 5 shows a state where sheet is taken from the first chain gripper to perfecting cylinder.
Figure 6:
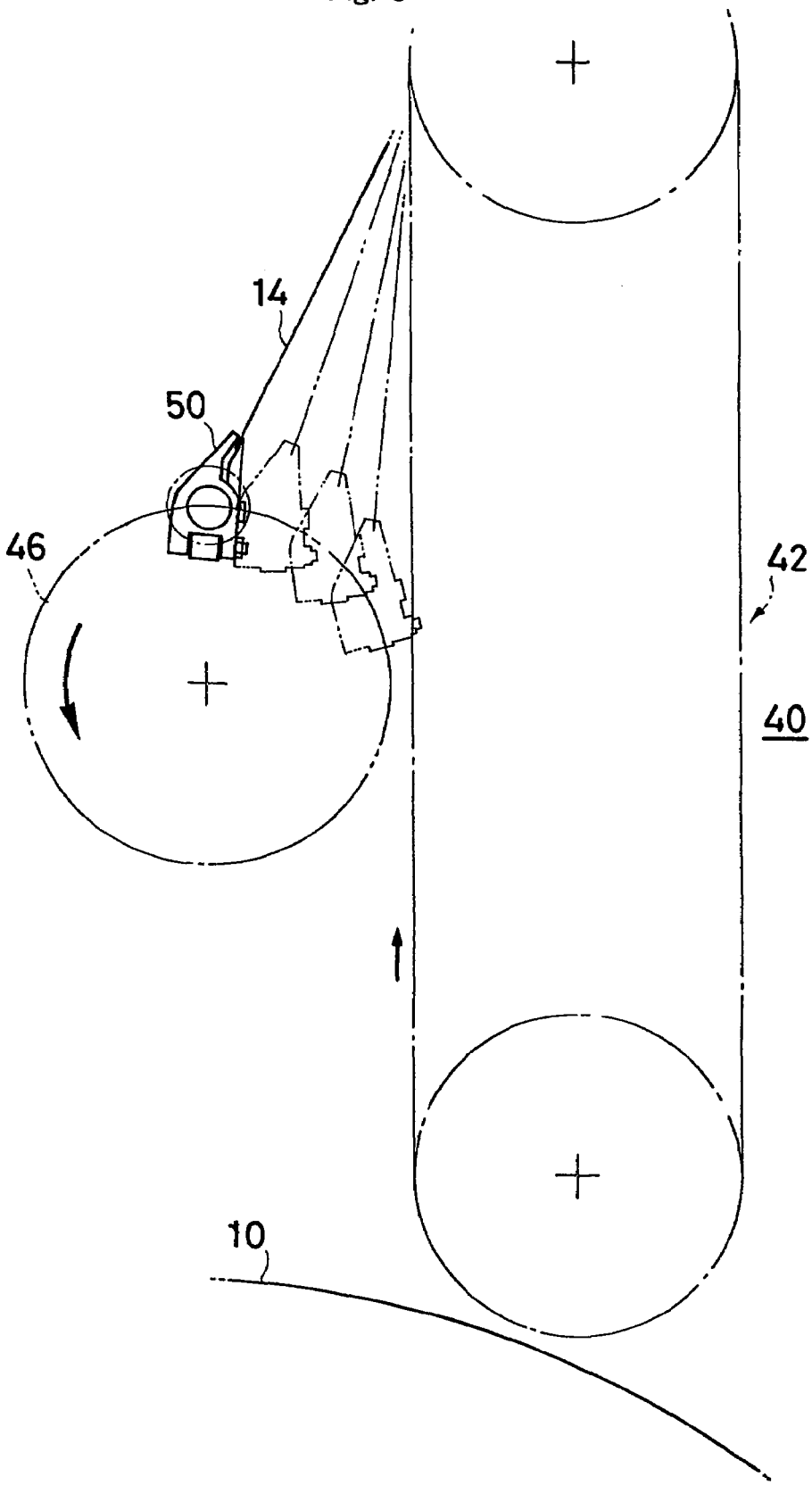
FIG. 6 shows a state where sheet is reversed by perfecting cylinder.
Figure 7:
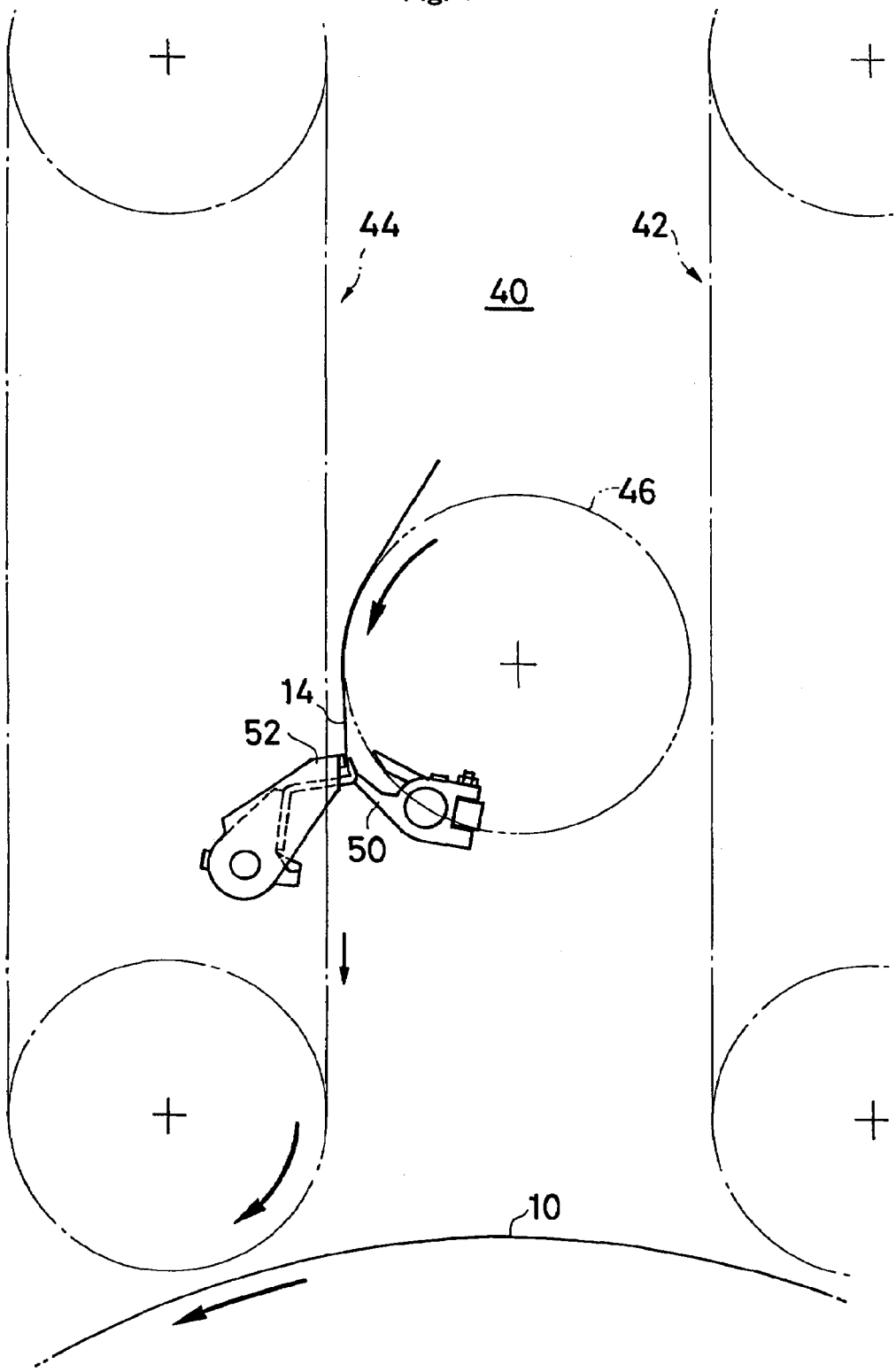
FIG. 7 shows a state where sheet is transferred from perfecting cylinder to the second chain gripper.
Figure 8:
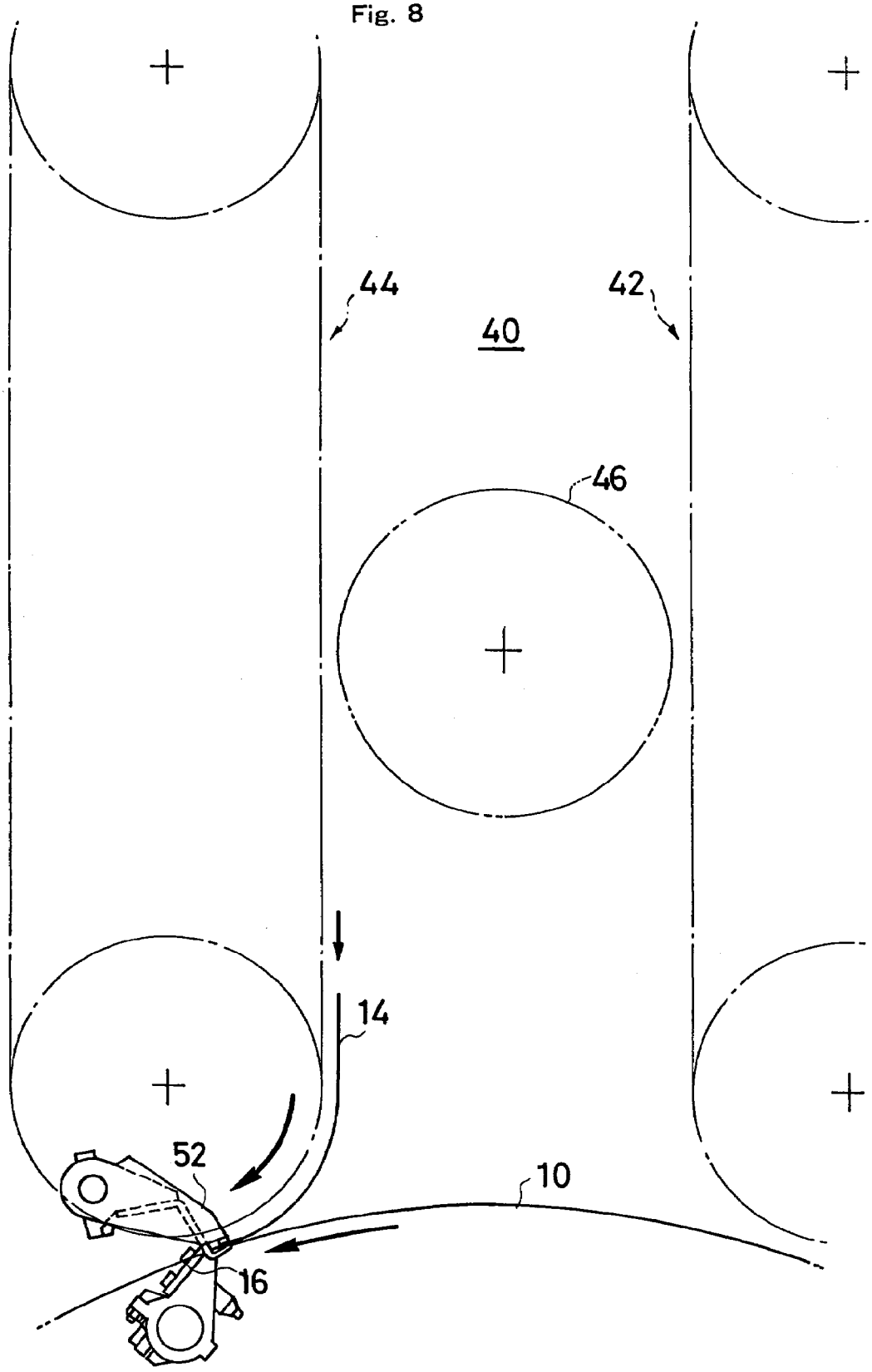
FIG. 8 shows a state where sheet is taken again by common pressure cylinder from the second chain gripper.

As shown in FIG. 4, front end of sheet 14 which has been gripped and transferred by gripper 16 of common pressure cylinder 10 is now accepted by gripper 48 of the first chain gripper 42. Then, sheet 14 is, as shown in FIG. 5, transferred away from common pressure cylinder 10 with running of the first chain gripper 42 and rear end of sheet 14 is gripped by perfecting gripper 50 of perfecting cylinder 46. Sheet 14 is then, as shown in FIG. 6, reversed with the rotation of perfecting cylinder 46 and taken up by gripper 52 of the second chain gripper 44 (FIG. 7). Thereafter, sheet 14 approaches again to common pressure cylinder 10 with running of the second chain gripper 44 and, as shown in FIG. 8, the reversed sheet 14 is delivered to gripper 16.

In the present invention, common installing portion 34 is provided at the position corresponding to the circumference of common pressure cylinder 10 by cutting out a part of side frames 12, because units to be added are all concerned with common pressure cylinder 10. The common installing portion 34 is opened toward outside of press, therefore, can be freely accessed to facilitate modification of press structure and variety of units can be commonly attached on the side frames 12.

As detailed, printing mode can easily be modified and convenience of satellite-type printing press can enormously be increased by versatile satellite-type press of the present invention, as variety of units can be added at will by utilizing common installing portion of side frames.

The present invention is not limited to the embodiment described hitherto. Various changes and modification can, of course, be made without departing from the spirit of the invention.

DESCRIPTION OF THE REFERENCE NUMERALS

10 common pressure cylinder
12 side frame
14 sheet
16 gripper
26 fixed printing unit
34 common installing portion
36 cap
40 printing unit
42 sheet perfecting unit
44 chain gripper
46 chain gripper
46 perfecting cylinder

What is claimed is:

1. A satellite-type printing press comprising:

a common pressure cylinder supported for rotation between a pair of side frames;

a plurality of circumferentially spaced satellite printing units arranged around said common pressure cylinder;

said pair of side frames having cut-outs to provide for a common installation portion between said side frames, said common installation portion being located between two spaced adjacent printing units;

said common installation portion having an open top and an open bottom, said open bottom facing an outer surface of said common pressure cylinder; and an auxiliary printing unit in said common installation portion in operative relation with the outer surface of the common pressure cylinder to carry out a further printing operation.

2. The satellite-type printing press of claim 1 comprising a removable cap on said side frames covering said common installation portion.

3. The satellite-type printing press of claim 1, wherein said auxiliary printing unit comprises a further satellite printing unit.

4. The satellite-type printing press of claim 1, wherein said auxiliary printing unit comprises a sheet perfecting unit.

5. The satellite-type printing press of claim 1, wherein said open bottom of the common installation portion is positioned so that said outer surface of the common cylinder extends through said open bottom.

6. The satellite-type printing press of claim 5, wherein said common installation portion has parallel vertical sides.

7. The satellite-type printing press of claim 1, wherein said common installation portion comprises a hollow member extending between said side walls and supported in said cut-outs therein.

8. The satellite-type printing press of claim 1, wherein said auxiliary printing unit includes a print roller in contact with the outer surface of said common pressure cylinder.

9. The satellite-type printing press of claim 1, wherein said auxiliary printing unit is secured on the side frames on an upper end thereof.

10. The satellite-type printing press of claim 1, wherein said auxiliary printing unit is driven from said common pressure cylinder.

* * * * *